US010871021B2

(12) United States Patent
Kun

(10) Patent No.: US 10,871,021 B2
(45) Date of Patent: Dec. 22, 2020

(54) CUPBOARD DOOR BALANCE SYSTEM

(71) Applicant: CMECH (GUANGZHOU) LTD., Guangdong (CN)

(72) Inventor: Ding Gou Kun, Guangdon (CN)

(73) Assignee: CMECH (GUANGZHOU) LTD., Guangdong (CN)

( * ) Notice: Subject to any disclaimer, the term of this patent is extended or adjusted under 35 U.S.C. 154(b) by 280 days.

(21) Appl. No.: 15/681,002

(22) Filed: Aug. 18, 2017

(65) Prior Publication Data

US 2017/0350181 A1 Dec. 7, 2017

Related U.S. Application Data

(62) Division of application No. 15/210,985, filed on Jul. 15, 2016, now abandoned.

(30) Foreign Application Priority Data

Dec. 29, 2015 (CH) ..... 201511022648

(51) Int. Cl.
*A47B 96/00* (2006.01)
*E05F 15/605* (2015.01)
(Continued)

(52) U.S. Cl.
CPC ..... *E05F 15/605* (2015.01); *A47B 95/02* (2013.01); *A47B 96/00* (2013.01); *E05D 13/14* (2013.01);
(Continued)

(58) Field of Classification Search
CPC .... E06B 15/605; E06B 15/627; E06B 15/681; E06B 15/686; E06B 13/145; E06B 13/14
(Continued)

(56) References Cited

U.S. PATENT DOCUMENTS 702,148 A 6/1902 Nettleton
799,398 A 9/1905 McMullen
(Continued)

FOREIGN PATENT DOCUMENTS

CA 1108198 A 9/1981
DE 2627894 A1 1/1978
(Continued)

OTHER PUBLICATIONS

Ludewig GmbH, Climber Installation Instructions, 3 pages, Aug. 23, 2016.

*Primary Examiner* — Katherine W Mitchell
*Assistant Examiner* — Jeremy C Ramsey
(74) *Attorney, Agent, or Firm* — McKee, Voorhees & Sease, PLC

(57) ABSTRACT

A balance system used with a door of a cupboard comprises a transmission shaft, a first pulley on the transmission shaft, and a balance component. The first pulley is connected to a door belt, one end of the door belt is secured to the first pulley, and the other end of the belt is connected to the door. The balance component comprises a balancing member, a balancing belt and a second pulley on the transmission shaft. One end of the balancing belt is connected to the second pulley, and the other end of the balancing belt is connected to the balancing member, such that the balancing member is hung on the second pulley. The first pulley and the second pulley rotate synchronously, and the door belt and the balancing belt are wound oppositely. With the balance system, a small driving force can open/close the door.

19 Claims, 5 Drawing Sheets

(51) Int. Cl.

| | |
|---|---|
| ***E06B 9/06*** | (2006.01) |
| ***E06B 9/11*** | (2006.01) |
| ***E06B 3/92*** | (2006.01) |
| ***E06B 3/50*** | (2006.01) |
| ***E05F 15/665*** | (2015.01) |
| ***A47B 95/02*** | (2006.01) |
| ***E05D 13/00*** | (2006.01) |
| ***E05D 15/26*** | (2006.01) |
| ***E05F 11/54*** | (2006.01) |
| ***E06B 7/082*** | (2006.01) |

(52) U.S. Cl.
CPC ..... *E05D 15/262* (2013.01); *E05F 11/54* (2013.01); *E05F 15/665* (2015.01); *E06B 3/5045* (2013.01); *E06B 3/927* (2013.01); *E06B 3/928* (2013.01); *E06B 7/082* (2013.01); *E06B 9/0638* (2013.01); *E06B 9/0661* (2013.01); *E06B 9/0676* (2013.01); *E06B 9/115* (2013.01); *E05Y 2900/20* (2013.01)

(58) Field of Classification Search
USPC ..... 160/188, 189, 190
See application file for complete search history.

(56) References Cited

U.S. PATENT DOCUMENTS

| | | | |
|---|---|---|---|
| 1,709,872 | A | 4/1929 | Peelle |
| 1,832,966 | A | 11/1931 | Cook et al. |
| 1,892,340 | A | 12/1932 | Guth |
| 1,965,262 | A | 7/1934 | Seregi |
| 2,237,800 | A | 4/1941 | Webber |
| 2,389,956 | A | 11/1945 | Castilonia |
| 2,621,723 | A | 12/1952 | Etten |
| 2,672,928 | A | 3/1954 | King, Jr. |
| 2,688,365 | A | 9/1954 | Garubo |
| 2,760,566 | A | 8/1956 | Musheli |
| 3,008,519 | A | 11/1961 | Hawkins |
| 3,304,994 | A | 2/1967 | Kozak |
| 3,378,059 | A | 4/1968 | Young |
| 4,819,376 | A | 4/1989 | Taddei |
| 5,062,464 | A | 11/1991 | Peterson |
| 5,163,494 | A | 11/1992 | MacNeil et al. |
| 5,170,108 | A | 12/1992 | Peterson et al. |
| 5,216,782 | A | 6/1993 | Schenck et al. |
| 5,688,168 | A | 11/1997 | Schlies |
| 5,814,658 | A | 9/1998 | Bouchard et al. |
| 5,893,403 | A | 4/1999 | Megens |
| 5,934,776 | A | 8/1999 | Motta |
| 5,983,971 | A | 11/1999 | Miller et al. |
| 6,145,568 | A | 11/2000 | Lundstrom |
| 6,311,757 | B1 | 11/2001 | Schuette et al. |
| 6,808,000 | B1 | 10/2004 | Peterson |
| 6,814,658 | B1 | 11/2004 | Rindoks et al. |
| 6,953,074 | B2 | 10/2005 | Cardinal |
| 7,156,142 | B2 | 1/2007 | Peterson |
| 8,302,654 | B2 | 11/2012 | McDonald et al. |
| 8,555,948 | B2 | 10/2013 | Park |
| 9,267,320 | B2 | 2/2016 | Kitterman |
| 9,637,964 | B1 | 5/2017 | Kun |
| 9,637,966 | B1 | 5/2017 | Kun |
| 2003/0041980 | A1 | 3/2003 | Schulte et al. |
| 2005/0126721 | A1 | 6/2005 | Fan |
| 2008/0009234 | A1 | 1/2008 | DeCastro et al. |
| 2010/0072868 | A1 | 3/2010 | Deem et al. |

FOREIGN PATENT DOCUMENTS

| | | | |
|---|---|---|---|
| DE | 4020334 | A1 | 1/1992 |
| DE | 202010011321 | U1 | 12/2010 |
| EP | 0945575 | B8 | 11/2006 |
| EP | 2248983 | B1 | 8/2009 |
| EP | 2586956 | A1 | 5/2013 |

CUPBOARD DOOR BALANCE SYSTEM

CROSS-REFERENCE TO RELATED APPLICATIONS

This is a Divisional Application of U.S. Ser. No. 15/210,985 filed Jul. 15, 2016, which claims priority to Chinese Serial No. 201511022648, filed Dec. 29, 2015, all of which are herein incorporated by reference in their entirety.

FIELD OF THE INVENTION

The present invention relates to a balance system used in a door of cupboard.

BACKGROUND OF THE INVENTION

A cupboard is used for storage, for example, a clothes cupboard, a kitchen cupboard and a shoes cupboard. A cupboard is usually equipped with a door. People can open the door to take something out, and close the door for preventing something inside the cupboard from humidification, and hiding articles so as to have a good appearance.

However, some prior art doors may be difficult to open, and they need great strength to open.

Therefore, some driving devices were installed in the door. Chinese patent CN203654983U provided a device to open/close a door, in which a motor is equipped, and the door can be opened/closed by controlling a forward-rotation/rearward-rotation of the motor. Although this method can solve the problem as to how to open/close the door without too much strength, some drawbacks exist, for example:

a) The door is opened/closed by controlling the forward-rotation/counter-rotation of the motor, which will involve a complex circuit;
b) The strength to open the door is not always constant, sometimes more strength is needed, but sometimes smaller. If the door is driven by a constant power of the motor, the door may more easily be damaged;
c) If the power of the motor must be controlled in order to open the door smoothly, a complex motor control system with high cost will be required;
d) If the door needs much strength to open and close a more powerful motor will also be required, at increased cost for the motor.

SUMMARY OF THE INVENTION

Therefore, it is desirable to provide a balance system used in a door of cupboard such that a small driving force can facilitate the door opening/closing. The present invention features easy operation, long lifetime, low cost and good stability.

The present invention is therefore provided as follows:

A balance system used on a door of cupboard, comprising a transmission shaft, a first pulley mounted on the transmission shaft, and a balance component; a pair of first pulleys connected to a pair of door belts in which one end of each belt is secured to one of the first pulleys, and the other end of each belt is connected to the door of cupboard; the balance component comprises a weighted balancing member, a pair of balancing belts, and a pair of second pulleys mounted on at the transmission shaft; one end of each balancing belt being connected to one of the second pulleys, and the other end of each balancing belt being connected to the balancing member, such that the balancing member is hung on the second pulleys; the first pulleys and the second pulleys rotate simultaneously, and the door belts and the balancing belts are wound inversely or oppositely.

In some embodiments, the balance system includes a motor transmission apparatus, comprising a reversible electric motor, a first gear secured coaxially to a shaft of the motor, and a second gear secured to the transmission shaft; with the first gear in meshing engagement with the second gear.

In some embodiments, an electric/manual switch is configured in the motor, for enabling the first gear and the second gear to be disengaged.

In some embodiments, the second gear is arranged at a center of the transmission shaft.

In some embodiments, the balancing member is an elongated member.

Further the two second pulleys are configured in bilateral symmetry at both sides of the center of the transmission shaft; the transmission shaft and the elongated balancing member have a same orientation, and the balancing belts are mounted at both ends of the elongated balancing member where their mounting points are in bilateral symmetry; the elongated balancing member is a homogeneous substance.

The present invention can bring the following benefits:

In the balance system used in a door of cupboard, the transmission shaft is equipped with a balance component, a pulling force or weight of the door corresponds to a pulling force or weight of the balancing member so as to make the balance system in balanced state. In this regard, a small driving force can make the system imbalance and facilitate the door opening/closing.

Further the balance component features simple structure, good stability and long lifetime, and can keep the door opening/closing smoothly.

Further the present invention also includes a motor transmission apparatus, an electric/manual switch is configured therein, to enabling the first gear and the second gear to be disengaged/engaged. Thus, the door can open/close manually or electrically. Meanwhile, since a balance component is introduced herein, only a small power output of the motor is required, causing the total costs to be lower.

DETAILED DESCRIPTION OF THE PREFERRED EMBODIMENTS

The present invention will be described hereinafter in details with reference to the figures.

Figure 1:
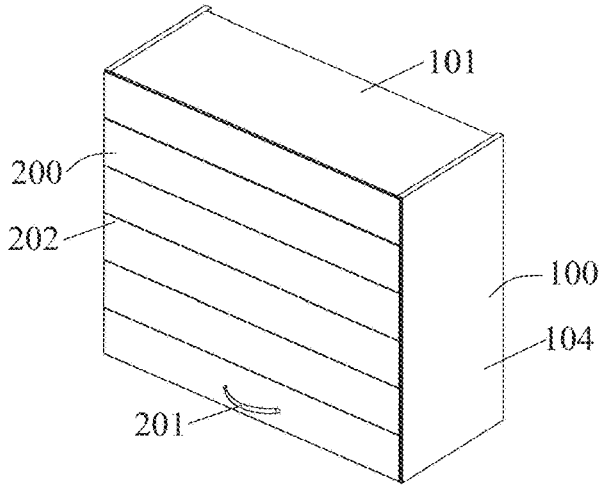
FIG. 1 is a structural schematic view of a cupboard according to the present invention, with the door closed.
Figure 2:
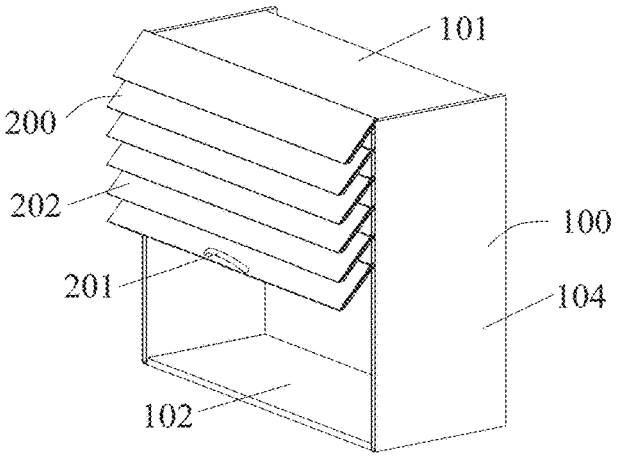
FIG. 2 is a structural schematic view of a cupboard according to the present invention, with the door partially opened.
Figure 3:
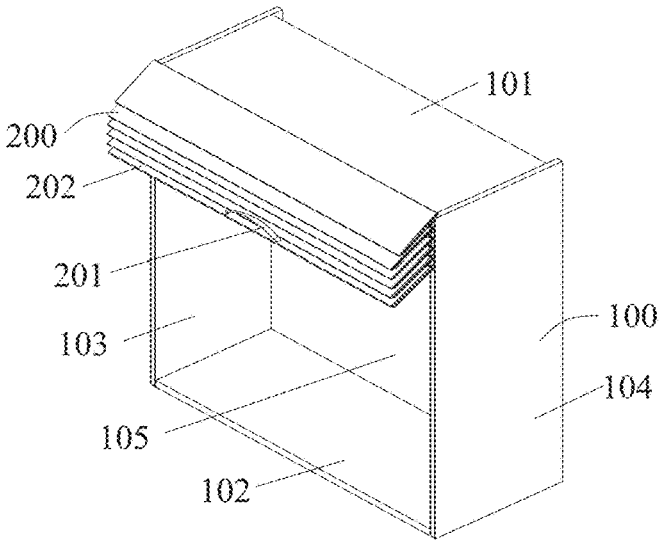
FIG. 3 is a structural schematic view of a cupboard according to the present invention, with the door opened fully.

A cupboard with a vertically movable, up-down door is shown in FIGS. 1-3. The cupboard comprises a body or box 100, a door 200 on the body 100, and a handle 201 on the door.

The door 200 adopts a lift louvered mechanism, comprising a plurality of louvers 202, a pair of lift racks 300, and a guideway 400 for each lift rack 300.

Each of the lift racks 300 comprises a plurality of first lift units 310, and a plurality of second lift units 320 in which each second lift unit 320 is connected to two adjacent first lift units 310. Each louver 202 is secured to each corresponding first lift unit 310.

Each first lift unit 310 comprises a first connective element or finger 311 securing to the louver 202, and a second connective element 312 hinged to the first connective element 311. Each second lift unit 320 comprises a third connective element 321 hinged to the first connective element 311, and a fourth connective element 322 hinged to the second connective element 312. Both the third connective element 321 and the fourth connective element 322 are hinged to each other. Thus, the elements 311, 312, 321, 322 form a scissor jack type assembly.

As shown in FIGS. 1-4, the cupboard has a door containing multiple louvers 202 which are secured onto the first lift units, 310 respectively, by any convenient means such as a strong adhesive, snap-fitting or port connection or the like. More particularly, each louver 202 is secured onto each corresponding first connective element 311 such that the louvers 202 can be mounted to the lift racks 300.

Figure 7:
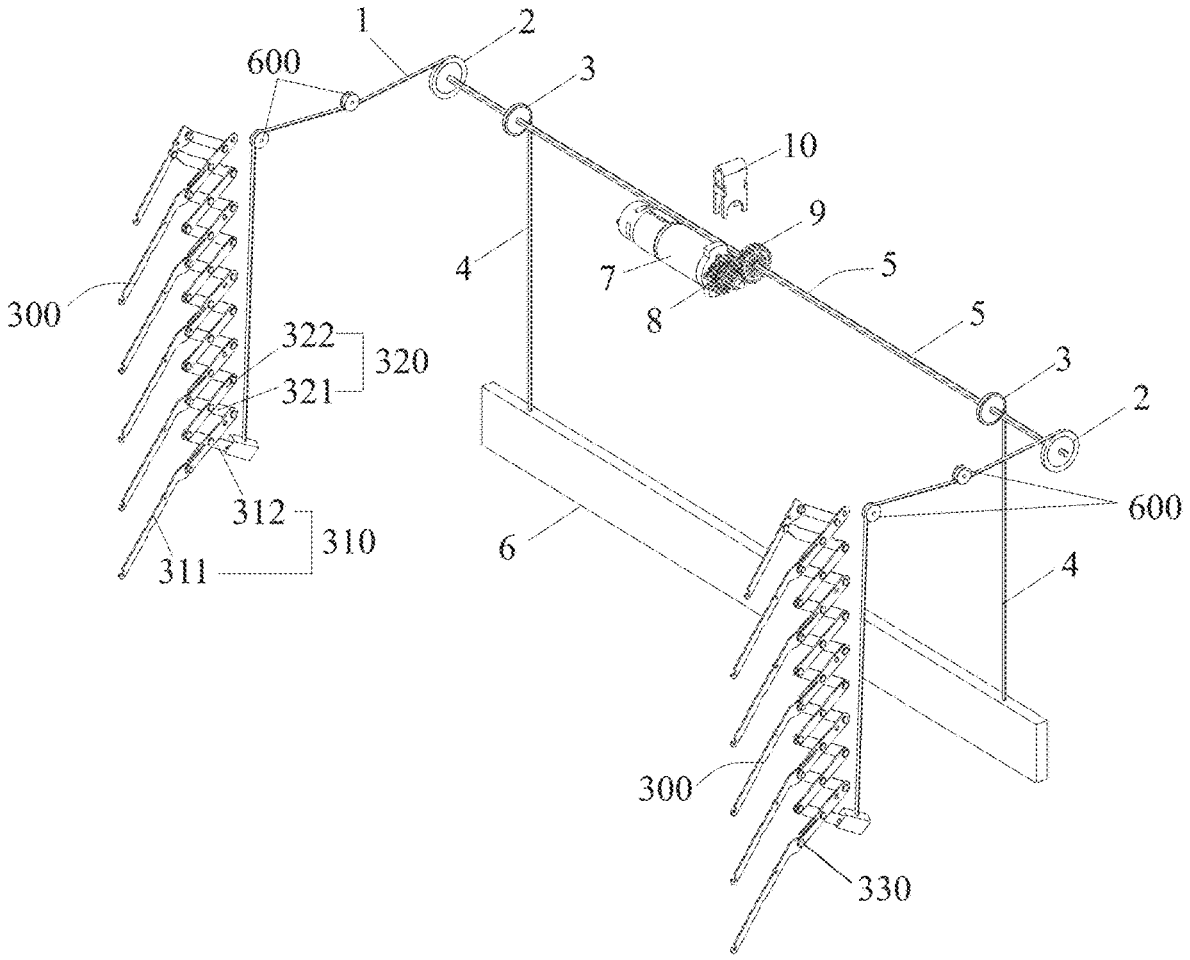
FIG. 7 is a perspective view showing the connection between the lift racks and the balance system.
Figure 8:
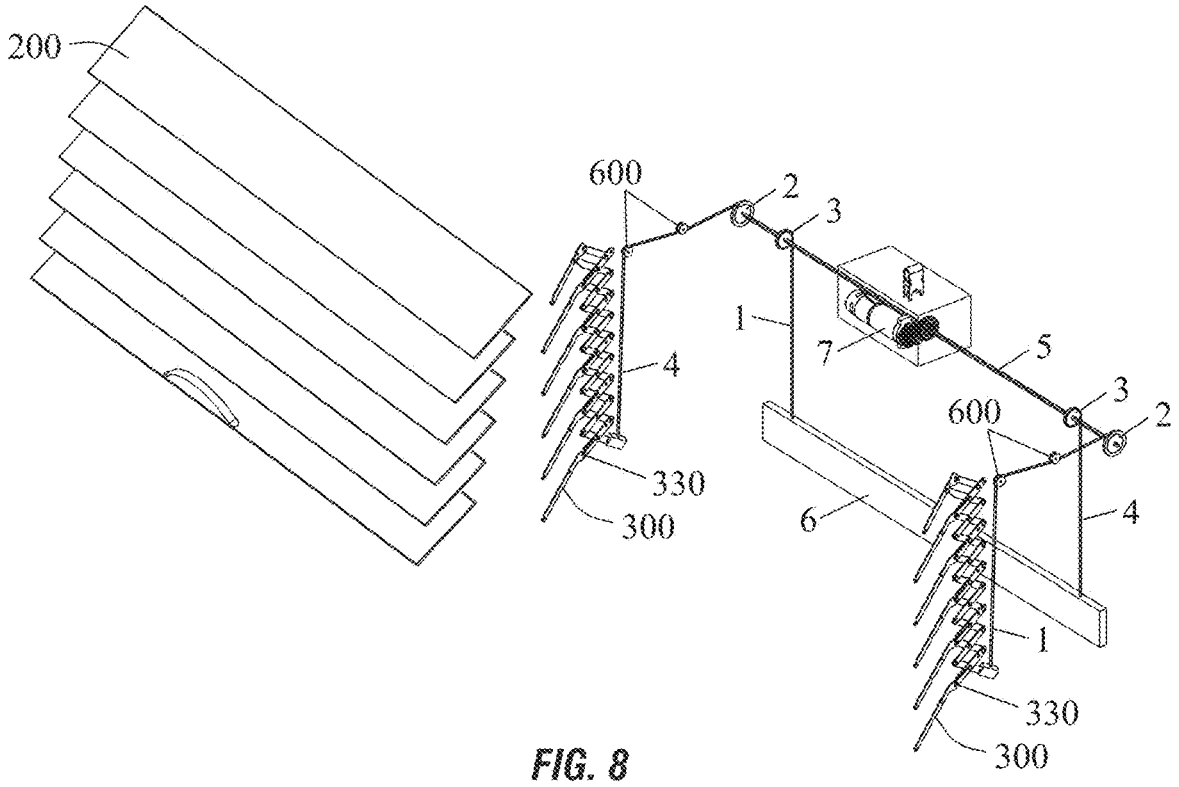
FIG. 8 is another exploded view, similar to FIG. 7, and having the door louvers.
Figure 9:
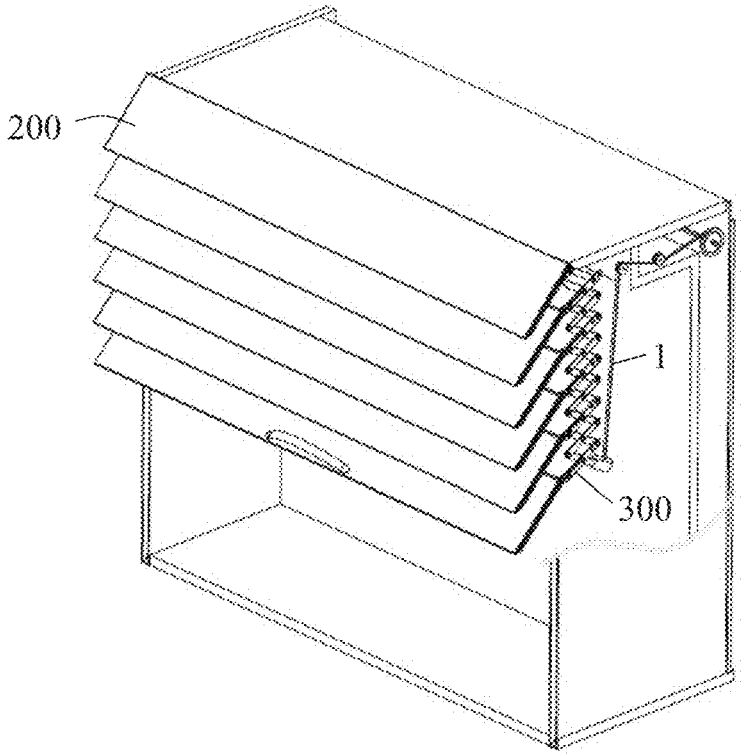
FIG. 9 is an assembled view of the cupboard, with one side wall removed to partially show the lift mechanism.

The body 100 consists of a top board 101, a bottom board 102, a left board 103, a right board 104 and a rear board 105. As shown in FIGS. 7-9, a mounting slot 1031 is configured at the left board 103, and a mounting slot 1041 is configured at the right board 104. Two guideways 400 are mounted inside the mounting slots 1031 and 1041, respectively, with each lift rack 300 connected to each guideway 400.

As shown in FIGS. 7 and 8, a guide protrusion 330 extends from the first connective element 311, and a guide groove 401 is provided in the guideway 400. The guide protrusion 330 can only be moved in the guideway 400 such that the lift rack 300 can lift and fold up, or, descend and extend, along the guide groove 401.

When people need to open the door 200, the lift racks 300 lift and fold up, causing the louvers 202 to fold up, the door is thus open.

When people need to close the door 200, the lift racks 300 descend and extend, causing the louvers 202 to extend, the door is thus closed.

Embodiment 1

Figure 4:
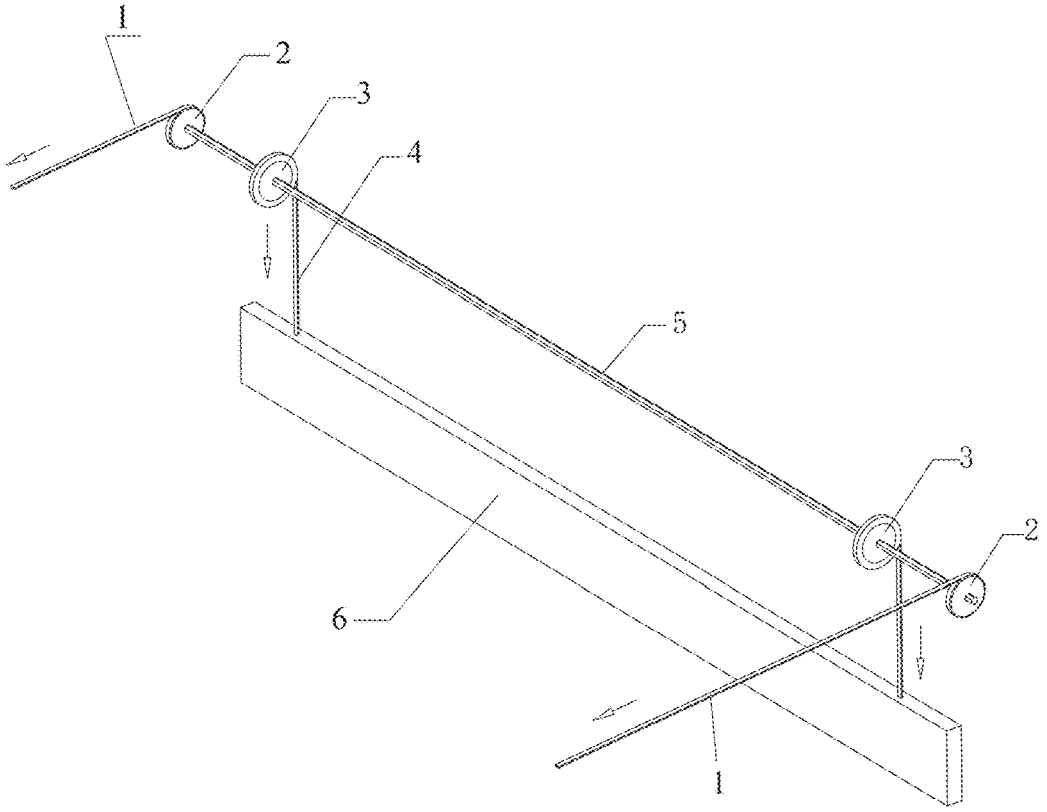
FIG. 4 is a structural schematic view of a preferred Embodiment 1 of a balance system used in a door of cupboard according to the present invention.

As shown in FIG. 4, a balance system used in a door of cupboard comprises a transmission shaft 5, a first pulley 2 on the transmission shaft 5, and a balance component.

The first pulley 2 is connected to a belt 1. One end of the belt 1 is secured to the first pulley 2, and the other end of the belt 1 is connected to the door of cupboard. Thus, the door provides the belt 1 with a pulling force due to the weight of the door.

The balance component comprises a balancing member 6, a balancing belt 4 and a second pulley 3 configured at the transmission shaft 5. One end of the balancing belt 4 is connected to the second pulley 3, and the other end of the balancing belt 4 is connected to the balancing member 6, such that the balancing member 6 can be hung on the second pulley 3 evenly and provides the balancing belt 4 with a pulling force due to the weight of the balancing member 6. A direction of the pulling force is shown by an arrow in FIG. 4. The first pulley 2, the second pulley 3 and the transmission shaft 5 can rotate synchronously. The belt 1 and the balancing belt 4 are wound inversely on the first pulley 2 and the second pulley 3 respectively.

Preferably, the pulling force from the door corresponds to the pulling force from the balancing member 6 so as to make the balance system in a balanced state. In other words, the weight of the door is substantially equal to the weight of the balancing member, so that the door and balancing member are in equilibrium.

As shown in FIG. 4, in this embodiment, the balance system comprises two first pulleys 2, and the balance component comprises an elongated balancing member 6, two second pulleys 3 and two balancing belts 4.

The two second pulleys 3 are configured in bilateral symmetry at both sides of a center of the transmission shaft 5, and the elongated balancing member 6 is a homogeneous substance. Preferably the transmission shaft 5 and the elongated balancing member 6 have a same orientation, and both balancing belts 4 are mounted at both ends of the elongated balancing member 6 where two mounting points are in bilateral symmetry such that the force borne by both second pulleys 3 will be substantially even.

Both second pulleys 3 are arranged between the two first pulleys 2. The pulling force from the door to the belts 1 corresponds to the pulling force from the balancing member 6 to the balancing belts 4 so as to make the balance system in a balanced state. In this regard, a small driving force can make the system imbalance and facilitate the door opening/closing.

The present invention features simple structure, low cost, good stability and long lifetime.

Embodiment 2

Figure 5:
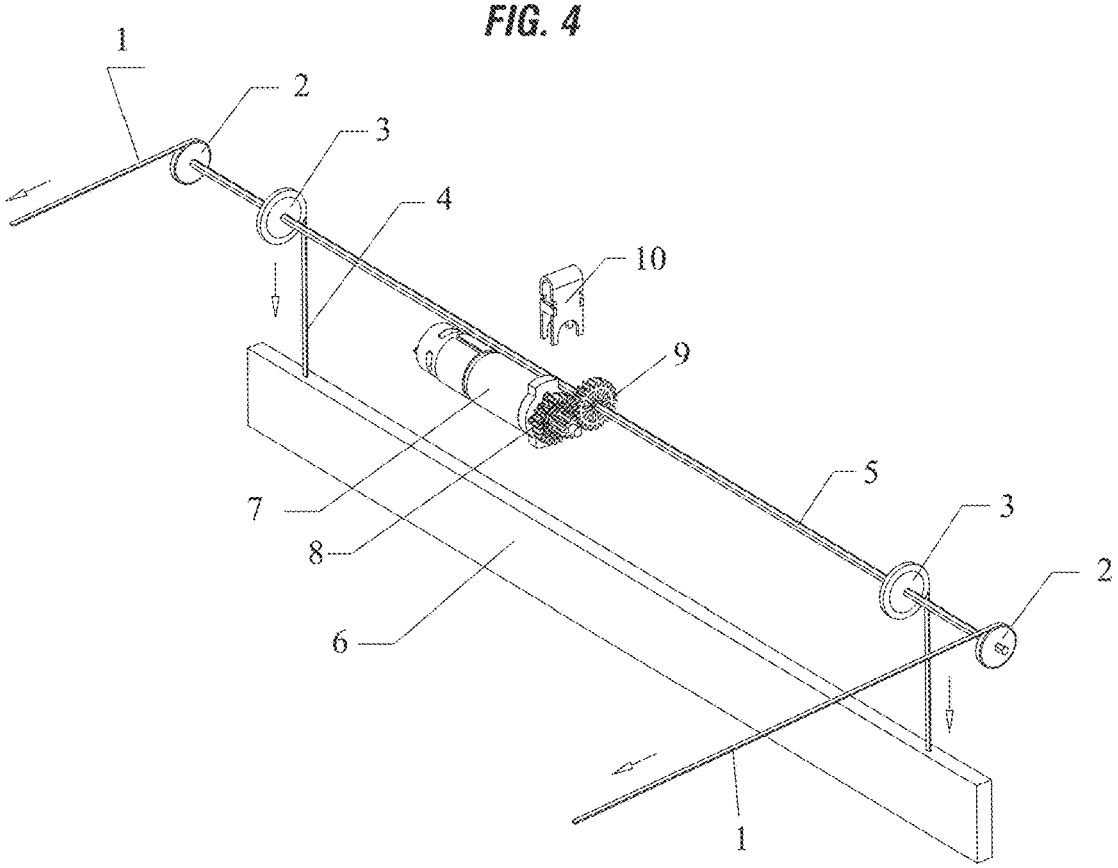
FIG. 5 is a structural schematic view of an alternative Embodiment 2 of a balance system used in a door of cupboard according to the present invention.
Figure 6:
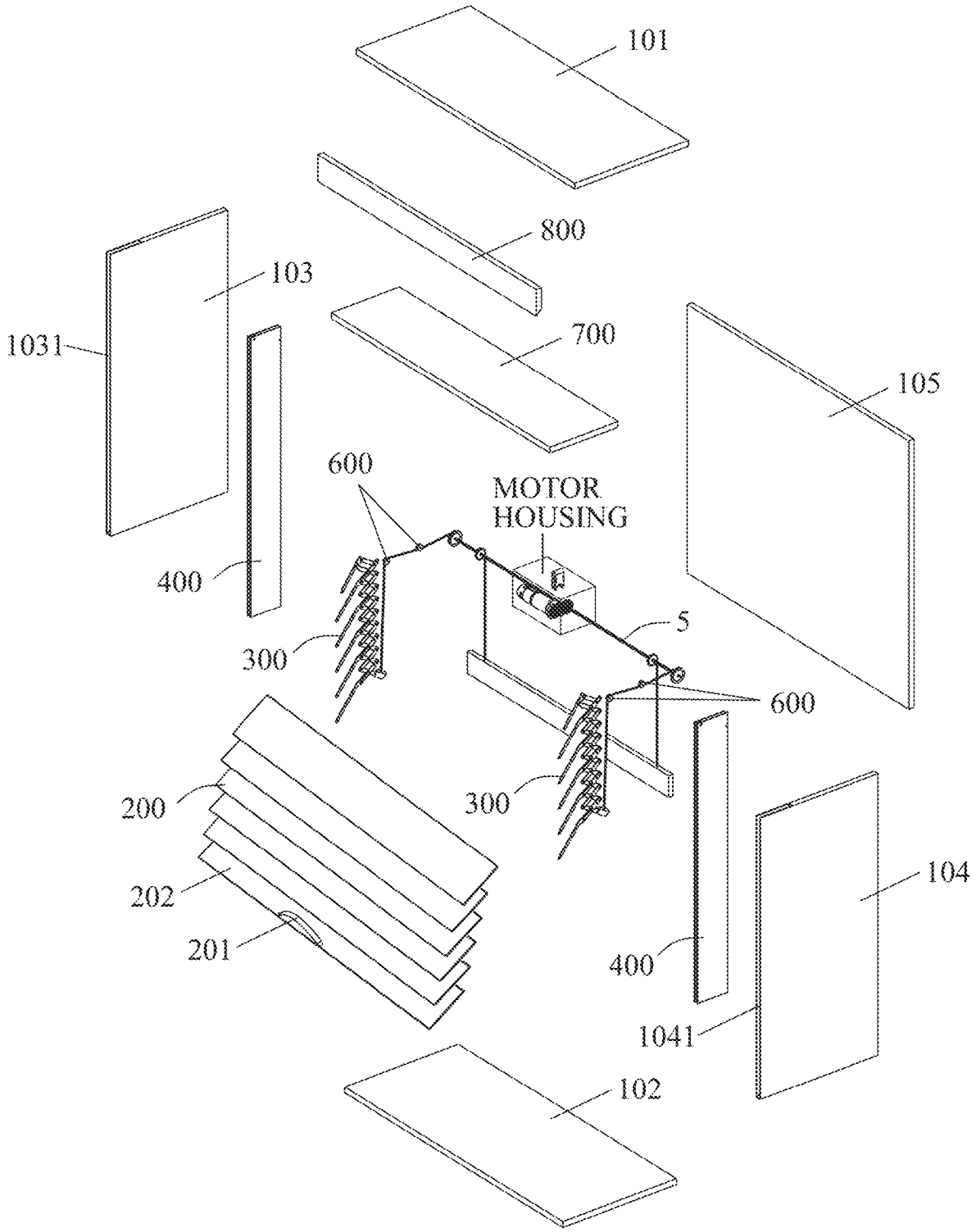
FIG. 6 is an exploded view showing the cupboard components.

In an alternative embodiment shown in FIG. 5, the cupboard 100 also includes a reversible, electric motor transmission apparatus, comprising a motor 7, a first gear 8 secured coaxially to the motor 7, and a second gear 9 secured to the transmission shaft 5, preferably at the center of the transmission shaft 5. The first gear 8 meshingly engages with the second gear 9.

An electric/manual switch 10 is operatively connected to the motor 7, for enabling the first gear 8 and the second gear 9 to be disengaged. When the first gear 8 and the second gear 9 are disengaged, the balance system will be in manual state, whereby, a little driving force to a handle, can make the system imbalance and open/close the door.

When the first gear 8 and the second gear 9 are engaged and the motor 7 is powered up to rotate, the transmission shaft 5 is rotated. The motor 7 generates a small driving force, which can make the system imbalance and open/close the door. Since only a small power output is required, the motor 7 cost is minimized. The present invention features good stability and long lifetime due to a balanced configuration.

In case no balancing member 6 is present, there is no pulling force from the balancing member 6 to balance the weight of the door. In this circumstance, when people need to open/close the door, the motor will supply a stronger pulling force, with more motor power. In addition, a motor controller may be required to control the motor's output, making the door open/close smoothly, and may require a complex transmission mechanism with a higher cost.

Regulating wheels 600 allow for adjustment of the belts 1, i.e., tightening or loosening the belts. The wheels 600 are mounted on the side boards of the cupboard.

It is understood that the belts 1 and 4 may also be any type of pulling or tension member, such as a cable, a cord, a chain, a rope, and the like.

The embodiments described hereinbefore are merely preferred embodiments of the present invention and not for purposes of any restrictions or limitations to the invention. It will be apparent that any non-substantive, obvious alterations or improvements by the technician of this technical field according to the present invention may be incorporated into ambit of claims of the present invention.

What is claimed is:

1. A cupboard, comprising:

a box with an open front, a back, and opposite sides;

a door mounted to the box for vertical movement between open and closed positions relative to the open front;

a pulley system mounted adjacent to the box back and connected to the door, wherein the pulley system comprises at least one pulley and at least one door belt extended substantially horizontally between at least one pulley and the door, and wherein the door belt has a rear end secured to at least one pulley and a forward end secured to the door; and a weight connected to the pulley system at a location behind the door to counter-balance the door.

2. The cupboard of claim 1 wherein the pulley system includes a first belt connected to the door and a second belt connected to the weight.

3. The cupboard of claim 1 wherein the pulley system includes a first pair of spaced apart belts attached to the door adjacent opposite edges of the door, and a second pair of spaced apart belts attached to the weight.

4. The cupboard of claim 3 wherein the pulley system includes a first pair of pulleys for winding and unwinding the first pair of belts and a second pair of pulleys to wind and unwind the second pair of belts.

5. The cupboard of claim 4 wherein the first and second pairs of belts wind and unwind in opposite directions on the first and second pairs of pulleys.

6. The cupboard of claim 1 further comprising a reversible motor operatively connected to the pulley system to raise and lower the door.

7. The cupboard of claim 6 wherein the reversible motor is laterally centered on the box.

8. The cupboard of claim 7 wherein the pulley system includes a shaft driven by the reversible motor, a pair of door pulleys mounted adjacent opposite ends of the shaft, a pair of weight pulleys mounted adjacent opposite ends of the shaft, a pair of door belts extending between the door and the door pulleys, and a pair of weight belts extending between the weight and the weight pulleys.

9. The cupboard of claim 8 wherein the reversible motor has a drive gear and the shaft has a driven gear in mesh with the door gear.

10. The cupboard of claim 8 wherein the door belts wrap around the door pulleys in a first direction and the weight belts wrap around the weight pulleys in a second direction opposite the first direction.

11. The cupboard of claim 1 wherein the weight is adjacent a rear portion of the box.

12. The balance system of claim 1, wherein the door includes a plurality of louvers interconnected by lift racks at opposite sides of the louvers, and the door belt being operatively connected to the lift racks.

13. The cupboard of claim 1 wherein, the door has a plurality of louvers and a rack system connected to the louvers to raise and lower the louvers when the pulley system is actuated.

14. The cupboard of claim 1 wherein the weight extends horizontally across the back of the box.

15. The cupboard of claim 1 wherein the door belt extends forwardly from the pulley.

16. A cupboard having a door and a pulley system for opening and closing the door, the pulley system comprising:

first and second pulleys rotatably mounted on the cupboard behind the door;

a first belt extending horizontally between the first pulley and the door;

a second belt extending vertically from the second pulley;

a weight on a lower end of the second belt to counter-balance the door.

17. The cupboard of claim 16 further comprising a shaft adjacent a rear of the cupboard, and the first and second pulleys being mounted on the shaft.

18. The cupboard of claim 17 further comprising a motor operatively connected to the shaft to rotate the shaft.

19. The cupboard of claim 16 wherein the first and second belts wind in opposite directions of the first and second pulleys, respectively.

* * * * *